US005429430A

United States Patent [19]

Johnson

[11] Patent Number: 5,429,430

[45] Date of Patent: Jul. 4, 1995

[54] DISPLAY SYSTEM AND METHOD

[76] Inventor: Joseph V. Johnson, 1409 E. Stockbridge La., Salt Lake City, Utah 84117

[21] Appl. No.: 175,246

[22] Filed: Dec. 29, 1993

[51] Int. Cl.[6] ..... A47F 3/06

[52] U.S. Cl. ..... 312/128; 186/55; 312/234.1

[58] Field of Search ..... 211/4, 41; 186/55; 206/455, 387.15, 387.11, 387.1; 312/128, 129, 138.1, 239.4, 234.1, 234

[56] References Cited

U.S. PATENT DOCUMENTS

| | | | |
|---|---|---|---|
| 788,164 | 4/1905 | McCaskey | 312/234.4 |
| 2,276,293 | 3/1942 | Farmer | 186/55 |
| 2,987,359 | 6/1961 | Kennon | 312/234 |
| 3,200,960 | 8/1965 | Banse | 312/234.1 |
| 3,204,774 | 9/1965 | Barbieri . | |
| 3,516,719 | 6/1970 | Weisblat . | |
| 3,695,452 | 10/1972 | Surman . | |
| 3,920,100 | 11/1975 | Dunphy . | |
| 4,243,142 | 1/1981 | Foreman . | |
| 4,285,558 | 8/1981 | Medford | 312/128 |
| 4,558,782 | 12/1985 | Iverson et al. | 206/387.11 |

*Primary Examiner*—Kenneth J. Dorner
*Assistant Examiner*—Gerald Anderson
*Attorney, Agent, or Firm*—M. Reid Russell

[57] ABSTRACT

A display system and method for its use including a narrow rectangular cabinet arranged for mounting onto an end of a retail store display that includes, across a top section, a number of spaced apart identical horizontal shelves of a depth to support a single item, such as a pack of trading cards, thereon. The shelves each support a number of items at spaced intervals, behind a transparent rail that extends at a right angle upwardly from the shelf face. The transparent rails include sequential number or letter identifiers fixed therealong, and may include bar codes next to which identifiers, for identifying the particular item fitted on the shelf centered immediately behind which identifier. The cabinet top section is covered by a transparent door that can be locked thereover, and the cabinet lower section can include a peg board with hanger arrangement. Order forms are provided that a customer, to select an item for purchase, marks the item identifier thereon that they then take to a separate store location whereat an inventory of items is maintained in a drawer insert or in boxes of the items. A divider is provided for separating piles of items in the drawer insert or with box of items, the divider having an identifier fixed thereto that corresponds to a particular pile or box of items to identify which items, the divider to also be used by the sales clerk to lift a top item off from a pile of items.

18 Claims, 5 Drawing Sheets

DISPLAY SYSTEM AND METHOD

BACKGROUND OF THE INVENTION

1. Field of the Invention

This invention relates to product display apparatus and methods for controlling sales and in particular to apparatus for displaying and maintaining trading card type items and a method for promoting sales thereof while providing protection from theft.

2. Prior Art

Display cabinets where products are displayed behind glass fronts or doors are, of course, common and have long been in use. Similarly, display apparatus involving glass doors or sliding panels with locks are well known. Some such apparatus, for example, are shown in a U.S. Patent to Barbieri, U.S. Pat. No. 3,204,774, that shows a counter display box for containing rings and the like, that is covered by a glass panel that can be locked thereover. Such device, of course, require a sales person to open the display to sell an article therefrom, rather than provides a display that a purchaser selects an item from with the purchase taking place at a separate location, as with the invention.

Similar to the above discussed Barbieri Patent, other display apparatus have involved vending machine devices, for example, a U.S. Pat. No. 3,920,100, such vending machine devices have involved different configurations of displays and display racks where sales of articles are made directly from the display, and have provided individual locking of items onto or in the display that must be unlocked to be removed by a sales person with a key to the display. For example, such arrangements are shown in U.S. Patents to Weisblat, U.S. Pat. No. 3,516,719; to Surman, U.S. Pat. No. 3,695,452; and to Foreman, U.S. Pat. No. 4,243,142. In such vending displays, the locks associated therewith must be released by a sales clerk to sell an item therefrom to a customer. Unlike the invention that provides a display only that a customer selects from, but does not purchase from, the invention involving a system that includes a display containing items such as packets of trading cards, with the customer indicating that selection by mark a form that is then taken to a separate store location whereat a sales person selects the desired item from a storage container of the system and sells that item or items to the customer.

SUMMARY OF THE INVENTION

It is a principal object of the present invention in a display system to provide display apparatus or cabinet that is to contain individually identified items as a customer determines to purchase and to make that purchase fills out an order form with the item identification that is taken to a location in a store for purchase.

Another object of the present invention is to provide a display system that involves a display apparatus that contain the individually identified items as are offered for sale, which display apparatus can be maintained in a locked condition, maintaining the integrity of the display, with purchase of the displayed items taking place at a separate location in the store.

Another object of the present invention is to provide a display system for attractively displaying a number of items, such as individual packs of trading cards, in individual bins so as to display the face thereof, which bins are individually marked as with numbers or letters, that a customer can copy onto a order form for purchase at a separate store location whereat the inventory of trading cards is maintained.

Another object of the present invention is to provide a display system that includes a transparent door for covering over the individual bins that can be locked to maintain the security of the items contained therein.

Another object of the present invention is to provide a divider bin as a component of the display system for maintaining the inventory of items that includes a flat bottom surface wherefrom a number of spaced walls projected at right angles upwardly that are spaced apart to accommodate a stack or stacks of items fitted between which walls, and includes a divider provided for each stack of items whereon an identification number or letter is fixed that corresponds with a number or letter fixed to a shelf area of the display cabinet, allowing a customer to order particular items with reference to its number or letter at the display cabinet.

Another object of the present invention is to provide a divider that can be used with the divider bin or with an open box of items, for identifying the number of items in the box with a number or letter identified associated with an individual display shelf area of the display apparatus.

Still another object of the present invention is to provide a divider that is formed so as to be useful by a sales person to pickup a top item off from a stack of items arranged in the divider bin or box.

Still another object of the present invention is to provide, with the display apparatus, an arrangement for maintaining order forms that a customer marks with the number or letter that designates a particular display apparatus/location shelf whereat a particularly item, such as a pack of trading cards, is maintained.

Still another object of the present invention is to provide a display apparatus with a capability for maintaining, for sale from the display apparatus itself, certain accessory items that are for use with the items as are displayed therein.

Still another object of the present invention is to provide a sales method for maintaining the security of items for sale so as to protect them from theft, such as packs of trading cards.

Still another object of the present invention is to provide a method for maintaining and selling items, such as packs of trading cards, whereby the purchaser does not have access to the individual items until they have actually purchased same.

Still another object of the present invention is to provide a method for maintaining and selling items, such as packs of trading cards, that restricts customer access of the items until their purchase is complete that can be easily handled by even minimally trained store personnel.

The invention in a display system includes a display apparatus formed as a narrow cabinet that is arranged for mounting, at a back section, onto a flat surface, such as the end of a grocery stored display cabinet. The narrow display cabinet of the invention is preferably formed as a rectangle with short side and end walls extending outwardly from the back section edges, and includes a transparent door that is connected by a hinge along a vertical edge to one of the short sides. A lock or locks are provided for securing the transparent door in covering arrangement over the narrow cabinet interior. A number of spaced horizontal shelves are provided across display cabinet interior that are of a depth to accommodate, side by side, a number of items, such as packs of trading cards, positioned thereon. Each shelf preferably includes a flat rail fitted thereacross that is formed of a transparent material such that each item can be seen therethrough, and is to maintain the items seated on the shelf.

Identifying markings, such as individual numbers, letters, or the like, are fixed, at intervals along each bar, to identify the area of the shelf behind which bar that which item is displayed in. The markings preferably run sequentially from along the top bar to along the bottom bar, or the bottom bar to the top bar. The spacing between markings is selected to accommodate the width of an item positioned of the shelf behind which marking, the marking thereby identifying a particular item. So arranged, a purchaser wishing to purchase a particular item that is located behind a particular marking can write that marking onto an order form to purchase that item at a store location whereat an inventory of items is maintained.

A bin apparatus or drawer insert may be included with the display system for maintaining an inventory of items. Specifically, the drawer insert apparatus that contains a number of upstanding parallel spaced apart walls that are spaced apart such that items, such as packs of trading cards, can be individually stacked therein, that is for fitting in a secure location, such as a drawer, is preferred. A number of dividers, that are each marked with a sequential marking, that can be a number, letter, or the like, and conforms to the markings fixed to the display cabinet bars, are each provided for seating on each pile of items. The divider is to identify each pile of items such that a sales person can quickly select a proper pile that contains the item or items the customer selects at the display cabinet by its marking. The divider is configured to further be useful as a tool to be held by a sales person in one hand for removing a top item off a pile of items, pivoting the one end of that item upwardly to be gripped by the fingers of the salespersons other hand. The sales person then conveys each selected item to the customer in exchange for the item purchase price.

Preferably a box is provided for maintaining order forms and a writing instrument, such as a pencil, are provided with of by the display cabinet. The display cabinet can further include a section that is not covered by the transparent door for maintaining items for sale, such as storage boxes, pages, and the like, for use with the displayed items, and sold separately therefrom. Further, where a store does not have secure drawer space that is appropriate for maintaining the bin apparatus, or chooses not to use such bin apparatus, then the dividers can be employed with individual boxes of the items, the dividers for positioning in front thereof to identify the box contents. Also, additional to the markings as are employed on the display cabinet bars and dividers, bar codes or the like, can also be secured thereto for scanning during a sale and for maintaining inventory control.

The method of the invention is preferably for controlling sales of items who are subject to theft and is practiced with the above identified display system. In a practice of which method a purchaser can see without having access to items in a display cabinet that area identified by number or letter identifiers. A customer views an item through a transparent door of the display cabinet by marking the item number on an order form that they then take to an area in the store where an inventory of items is maintained. The inventory can be separate piles of items maintained in the bin apparatus or in individual boxes, which piles are separated by dividers that include the item markings thereon. A sales person receiving the order form refers to the numbers on the individual dividers and selects a proper pile or box of items, and picks a top item or items from that pile for sale to the customer. The customer purchases that item by paying the sales person who, using a bar code reader, both determines the item price and reflects the sale as having depleted the inventory of the particular item. Which information can then be used for ordering additional items to maintain a certain level of inventory.

Other objects, features and advantages of the invention will be readily apparent from the following description of a preferred embodiment of the invention taken in conjunction with the accompanying drawings in which:

DETAILED DESCRIPTION

In a retail sales store small items, such as packs of sport or trading cards, are difficult to market. This is due to the fact that, though they are popular items, because of their small size they are often stolen. Accordingly, store owners are reluctant to stock such items as the danger of their theft does generally not outweigh the benefits of offering them for sale. The present invention provides a system with apparatus to both promote sales of these articles by having them on permanent display, and controls physical access to such items prior to their purchase. Accordingly, a store owner employing the display system of the invention can reap the benefit of sales of such items while minimizing a threat of loss through their theft.

Figure 1:
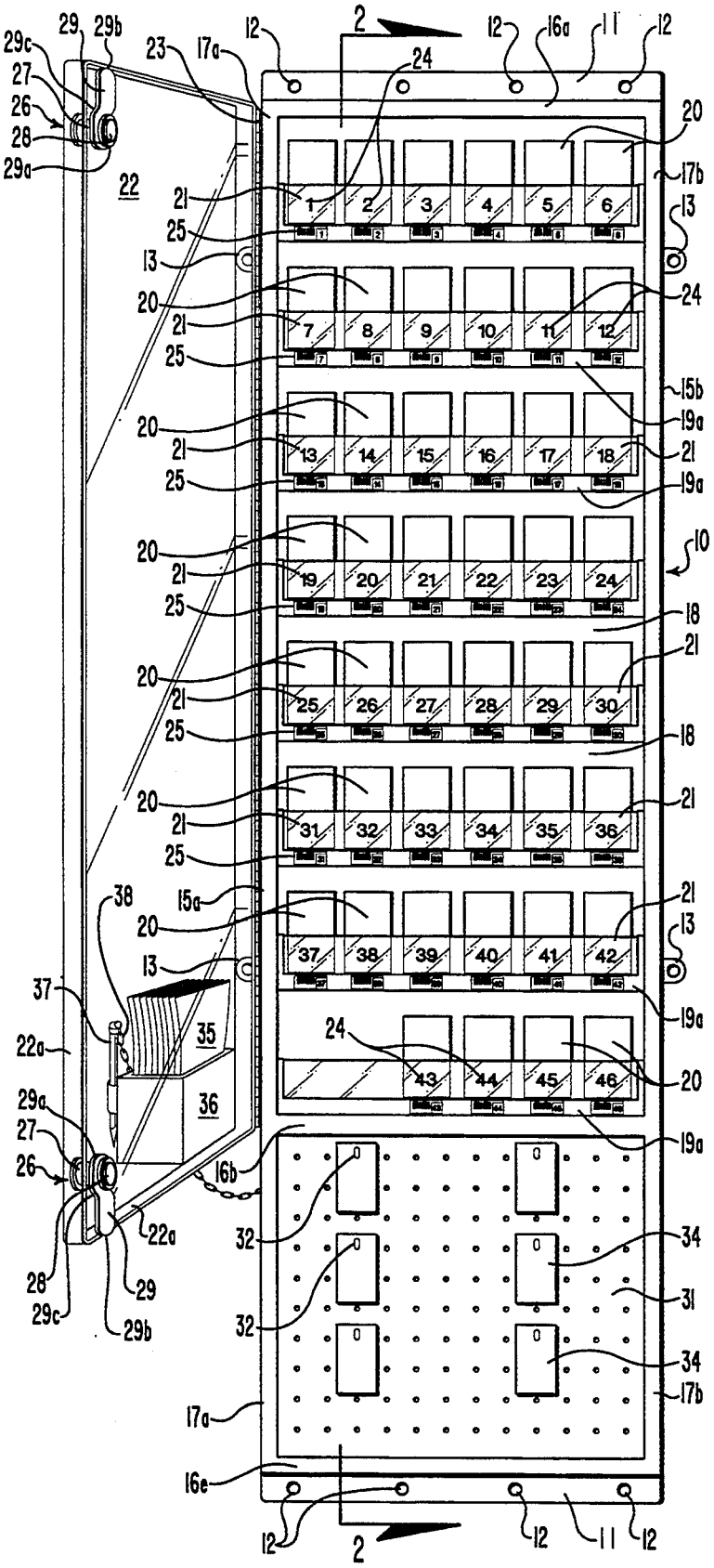
FIG. 1 is a front elevation perspective view of a display cabinet of a display system of the invention shown as a long narrow rectangular cabinet that includes an upper section with a number of equally spaced apart horizontal shelves with a transparent door that is shown as incorporating locks for maintaining it over the cabinet upper section, the cabinet including a lower portion that is covered by a section of peg board with hooks shown seated in the peg board holes.

In FIG. 1 is shown a display cabinet 10 of the display system of the invention, hereinafter referred to as cabinet, with the cabinet 10 shown in profile sectional view in FIG. 2. Shown in FIGS. 1 and 2, the cabinet 10 includes a back mounting wall 11 that is preferably formed of a thin material, preferably a plastic, and has a long rectangular shape. A number of mounting holes 12 are formed at spaced intervals across the back mounting wall 11 opposite ends, with the back mounting wall also including ears or tabs 13 that extend outwardly at intervals from the mounting wall sides, in the plane thereof, that have holes formed therethrough. The mounting holes 12 and the holes in tabs 13 are for receiving fasteners, such as screws, bolts or the like, not shown, fitted therethrough for mounting the cabinet 10 onto a surface, such as the end of a display case in a store or market.

Figure 2:
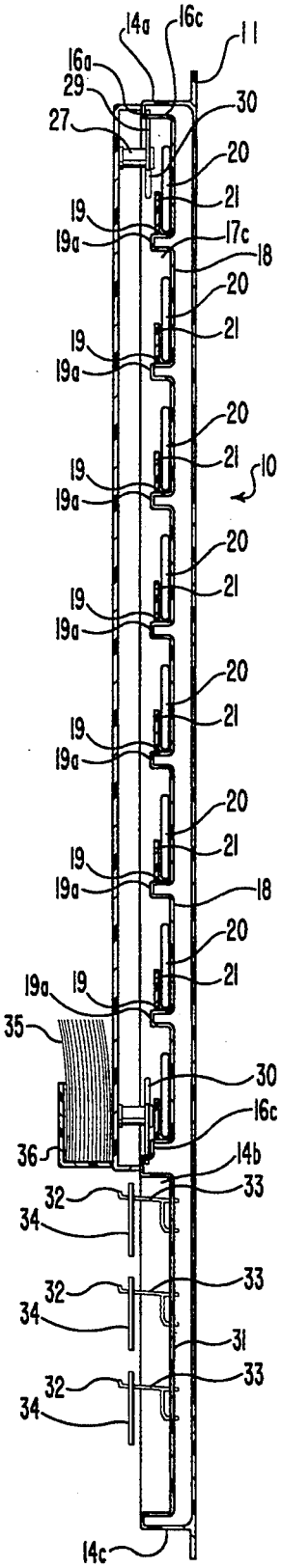
FIG. 2 is side elevation section view taken along line 2—2 in FIG. 1, and showing a box mounted onto an outer face of the transparent door than maintains a number of order forms therein.

The back mounting wall 11, as shown best in FIG. 2, is bent forward through ninety (90) degrees around its top, bottom and side edges and across it lower section, into short top, mid and bottom walls 14*a*, 14*b* and 14*c*, and left and right side walls 15*a* and 15*b*, respectively. The cabinet walls are bent inwardly at ninety (90) degrees into narrow top, mid and bottom and left and right forward faces 16*a*, 16*b*, 16*e*, 17*a* and 17*b*, respectively. Inner walls 16*c* and 17*c* are secured to extend at right angles inwardly from the inner edges of the top and mid and right and left forward faces 16*a*, 16*b*, 17*a* and 17*b*, and connect to a forward mounting wall 18, with a bottom forward face 16*e* formed across the cabinet bottom. Shown in FIG. 2 the back and forward mounting walls 11 and 18 with the forward faces 16*a*, 16*b*, 16*e*, 17*a* and 17*b* and connected walls are shown as having a hollow space or core therebetween, providing a strong light weight mounting wall that can be easily installed. In which construction, the back and forward mounting walls 11 and 18, can be formed separately, as by vacuum forming methods, including the formation of which right angle and inner walls, with forward faces 16*a*, 16*b*, 16*e*, 17*a* and 17*b*, for joining, as by gluing, heat bonding, or the like to form the finished mounting wall that is strong, light weight, and resists warping. Of course, within the scope of this disclosure, the mounting wall can be formed as a solid unit of wood, plastic, metal, or the like.

Figure 8:
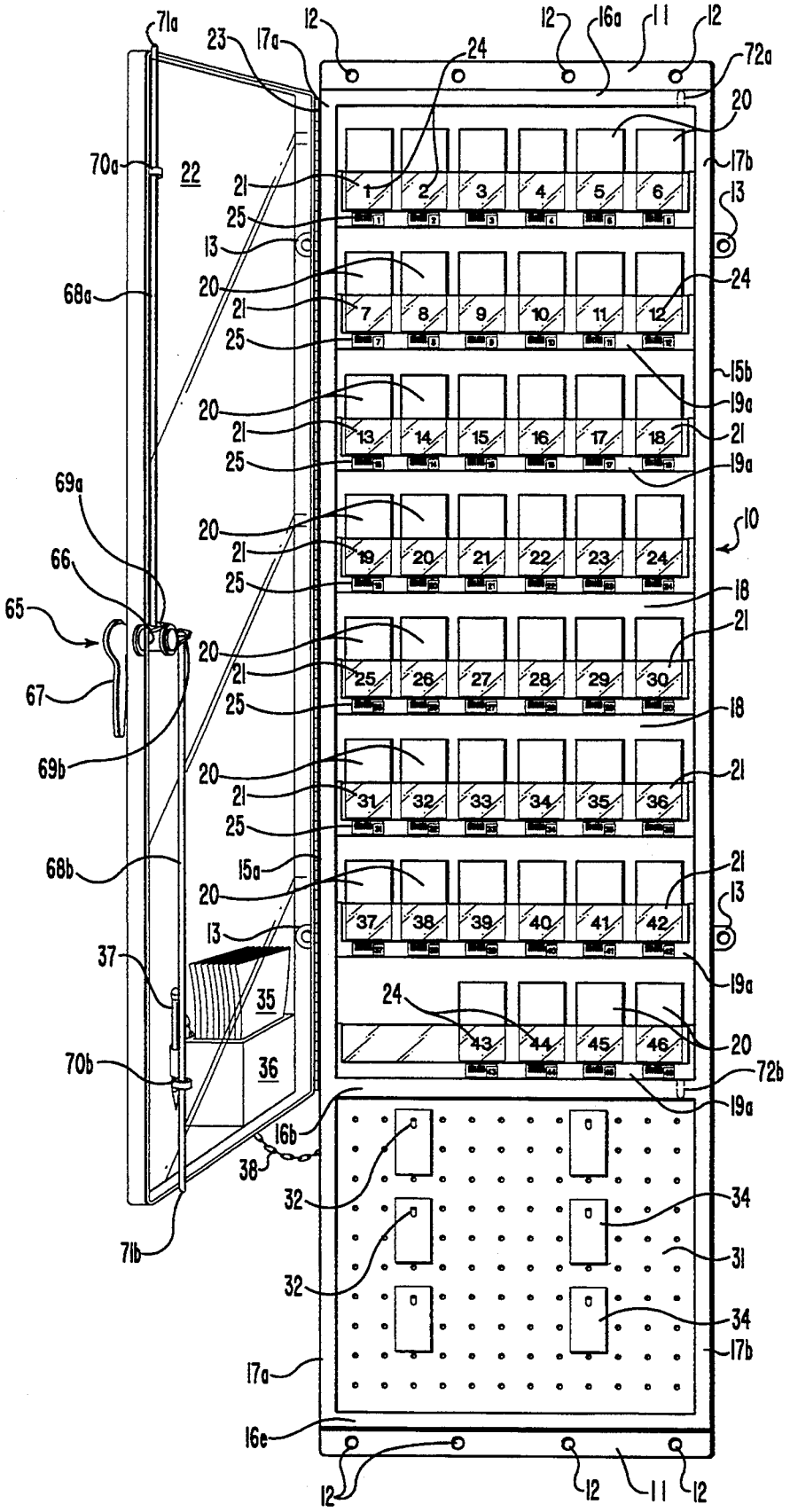
FIG. 8 is a view like that of FIG. 1 only showing another embodiment of a door lock configuration for the display cabinet transparent door.

The cabinet 10 is for displaying a number of like size items to the public. For example, packs of different sports or trading cards 20, are shown in FIG. 1. For supporting which packs, as shown best in FIG. 2 and as set out below, horizontal shelves 19 are formed to extend outwardly from the forward mounting wall 18. The shelves 19, are preferably of the same length and each extends across the forward mounting wall 18, between right and left forward faces 17*a* and 17*b* and top and mid faces 16*a* and 16*b*. The shelves 19 are spaced apart a distance to comfortably accommodate the height of a pack of trading cards 20 seated thereon, as shown in FIGS. 1, 2 and 8.

The shelves 19, as shown best in FIG. 2, are preferably formed in the process of forming the forward mounting wall 18 to have a thickness to accommodate the width of an item, shown as a pack of trading cards 20 seated thereon, and is preferably slightly shorter than the planner surfaces of top and mid and left and right faces 16*a*, 16*b*, 17*a* and 17*b*. It should, of course, be understood that, while cabinet 10 is shown as containing packs of trading cards 20, other items could be so displayed within the scope of this disclosure.

For retaining the packs of trading cards 20 on the shelves 19 a flat rail 21 is preferably secured onto the shelf so as to be in alignment with a forward face 19*a* thereof. The flat rail 21 is to retain the foot of each of the packs of trading cards 20, the packs positioned at intervals along each shelf 19, as shown in FIGS. 1 and 8. To encourage customer inspection of each of the packs of trading cards 20 the flat rail 21 is preferably formed of a transparent material, preferably a plastic such as , whereby a purchaser can clearly see the bottom portion of each pack therethrough. The flat rail 21 is preferably of a thickness to extend a distance up the pack to a height to facilitate a sale clerk easily fitting a pack of trading cards 20 therebehind. The packs of trading cards nest between the shelf it is positioned on and the shelf above, as shown in FIG. 2.

The cabinet 10 is, of course, for displaying items, shown as packs of trading cards 20, for sale to a customer. Accordingly, to maintain the security of which display, a door 22 that is preferably formed from a transparent material, preferably a plastic such as acrylic, is mounted at hinge 23 to the forward mounting wall 18 left forward face 17*a*. The door 22 is to swing across the cabinet front to the right forward face 17*b*, covering over the cabinet interior that contains the shelves 19. So arranged, a customer can inspect the packs of trading cards 20 through the transparent door 22 and flat rail 21, and select a particular pack or packs for purchase without physically touching the displayed packs of trading cards.

To communicate a customers selection to a sales person who will make the sale, an area behind each flat rail is designated as a shelf area or bin that is of a width to conveniently accommodate a pack of trading cards 20 and is identified with a mark, such as a number 24, fixed to the flat rail 21 outer surface. As shown in FIGS. 1 and 8, the areas behind each flat rail are identified by numbers 24 from (1) to (46). Which numbers 24 provide an inventory control, as set out hereinbelow, to enable a customer to order and fill that order at a separate store location, whereat inventories of the packs of trading cards 20 are maintained. Additional to the individual bin numbers 24, each area designated as a bin behind the flat rail 21 can include a bar code label 25 secured thereto for providing inventory control, as set out hereinbelow.

To maintain the security of the cabinet 10, the door 22 is preferably provided with a lock arrangement. FIG. 1 shows a pair of key locks 26 each mounted in an opposite corner of the door 22 away from the hinge 23 edge. The door 22 is shown to include a right angle lip 22*a* extending therearound that mounts, along one side, one side or leg of hinge 23, with the other hinge leg shown secured to the cabinet left side wall 15*a*. The door right angle lip 22*a* provides for both off-setting the door from the top and mid and right and left forward faces 16*a*, 16*b*, 17*a* and 17*b*, respectively, and for strengthening the door against warping. The right angle lip 22*a* is adjacent to a key lock 26 barrel 27 of each of the pair of key locks 26 that is mounted through the door 22 face, each proximate to one door end. The barrel 27 includes a key hole a cylinder 28 journaled therethrough that is turned by turning a key, not shown, that is fitted in the key hole. A narrow arm 29 is secured on one end 29*a* to the cylinder 28 end opposite to the key hole. The arm 29 turns with the cylinder 28 such that an opposite rounded arm end 29*b* will travel into a slot 30, shown in FIG. 2, that is formed in the inner wall 17*c*, to provide a locking of the door 22 over the cabinet 10 front top or upper section. To off-set the rounded arm end 29*b* away from the door 22, so as to enable that rounded arm end to travel into slot 30, the arm 29 is preferably bent through a dog leg 29*c*, at approximately a mid-point thereof.

As shown in FIGS. 1 and 8, a lower section of cabinet 10 is not covered by door 22. This lower section between the mid and bottom and left and right forward faces 16*b*, 16*e*, 17*a* and 17*b*, is shown as being approximately square and frames a flat section of peg board 31. The peg board 31 can be formed by drilling holes at appropriately spaced intervals into the lower portion of the forward mounting wall 18, or can be separately installed, within the scope of this disclosure. The holes in peg board 31 are spaced appropriately apart to accommodate conventional peg board hangers 32 that are fitted therein. The individual peg board hangers 32, as shown best in FIG. 2, include a rod 33 that extends outwardly from the peg board that is upturned on its end to receive an item 34 fitted thereon. The item 34 may be a container for maintaining trading cards, a set of trade cards holders, or the like, for sale separately from the packs of trading cards, within the scope of this disclosure.

Figure 3:
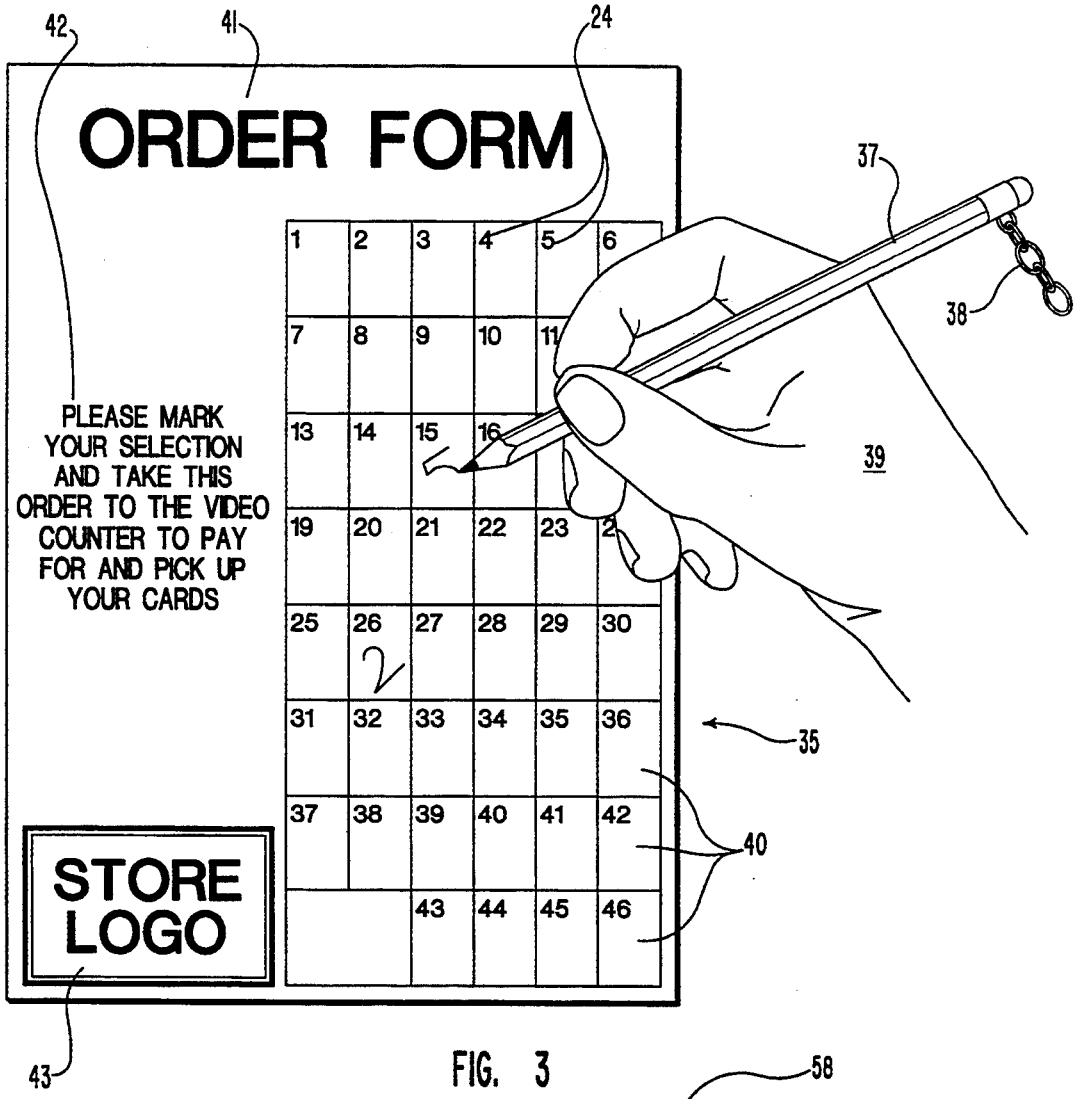
FIG. 3 is a front elevation view of an order form of FIG. 2 that is shown being marked by a pencil held by a customer.
Figure 5:
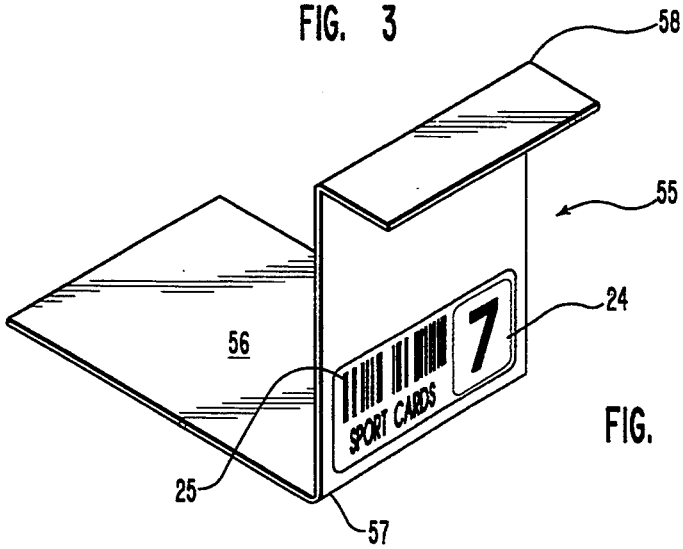
FIG. 5 is an enlarged side elevation perspective view of one of the dividers of FIG. 4.

The cabinet 10 of the invention, as set out above, is for displaying items, such as packs of individual trading cards 20, to a customer and potential purchaser, without allowing that customer to have physical access to the displayed items. Such customer, upon selecting an item or items 20, notes the number or numbers 24 of such items that they then write onto an order form 35, as shown in FIG. 3. For convenience, a container 36, shown as an open top rectangular box, is secured to the outer face of door 22, for containing a stack of order forms 35 therein. For convenience, a pencil 37 can be attached, as by a light chain 38, or cable, to the container 36.

To order an item or items, a customer, shown as a hand 39 in FIG. 3, writes with pencil 37 a number in one or a number of blocks 40 that are themselves numbered with sequential numbers 24 that correspond to the numbers on each areas on the shelves of 19 of cabinet 10 for maintaining an item displayed thereon. In which order marking, the customer can indicate the number of a particular item or items identified by numbers 24, as they desire to purchase. Shown in FIG. 3, additional to the blocks 40 that are numbered with numbers 24, the form may include a title 41, instructions 42 and a store logo 43, and, or other information, printed thereon as a store or seller determines.

The customer, after having filled out the order form 35, takes that form to a store location whereat inventories of the individual items, shown herein as packs of trading cards 20, are maintained. This area may be described at instructions 42 on order form 35, shown to be the video counter. Though, of course, another store location could be so used. Thereat, the order form 35 is given to a sales clerk who fills that order from an inventory of items and conveys the item or items to the customer on their paying for same, thereby completing the sale.

Figure 4:
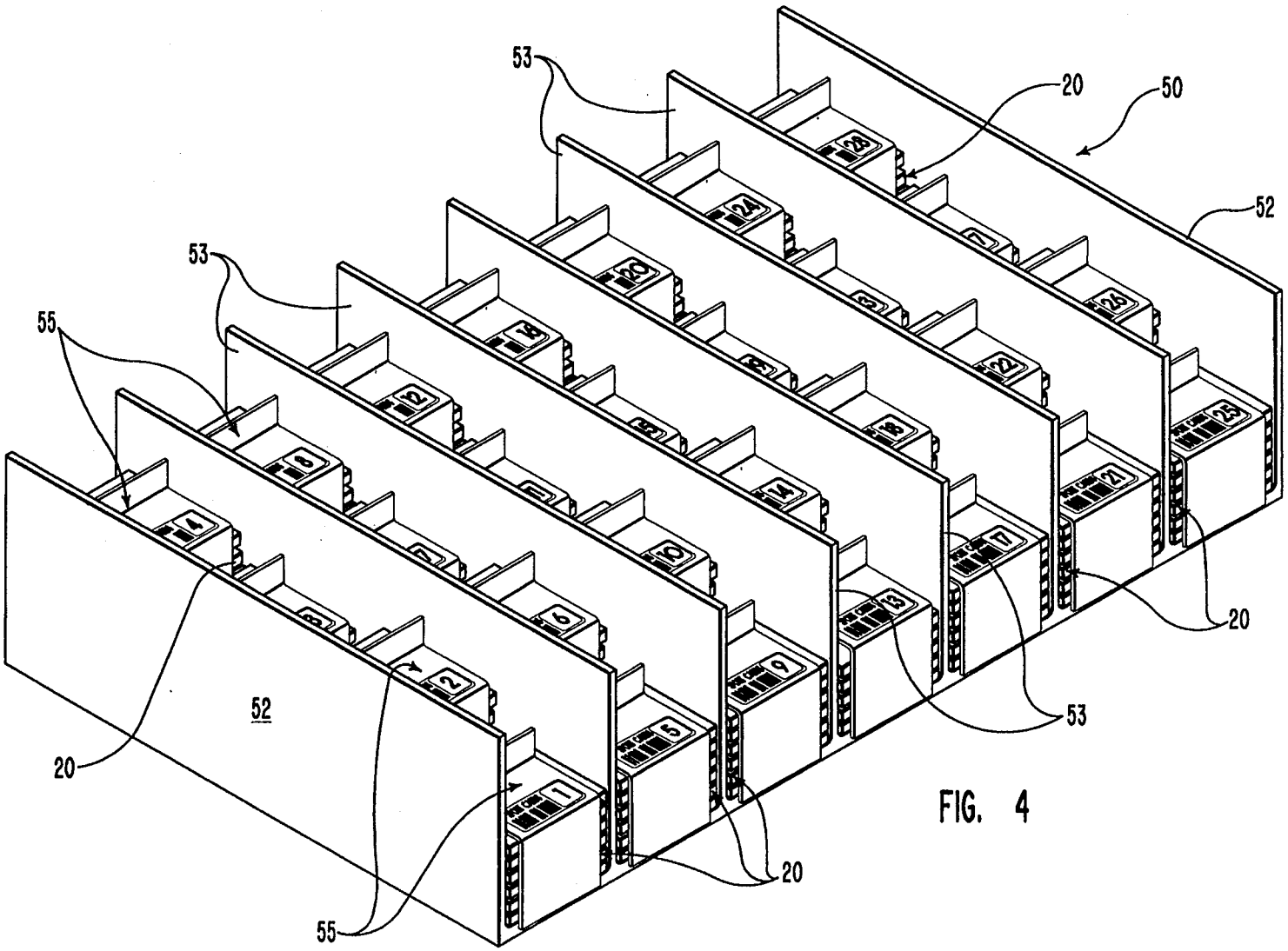
FIG. 4 is a top plan perspective view of an item drawer insert of the display system of the invention shown as containing, between upright walls, a number of piles of items, each pile shown as having a divider seated on top of each pile.

FIG. 4 shows a drawer insert 50 that can be used to separate and maintain individual piles of items, such as packs of trading cards 20, according to their numbers 24. The drawer insert 50 is formed to fit within a drawer, not shown, within a secure store area, which drawer may itself be lockable. The drawer insert 50 preferably includes a thin flat bottom 51 wherefrom a number of equally spaced parallel divider panels 53 extend, between opposite parallel ends 52. The end and divider panels 52 and 53 are spaced apart from one another an equal distance to accommodate packs of individual items therebetween. The piles are arranged end to end, shown herein as piles of packs of trading cards 20. Preferably, the drawer insert 50 is formed from plastic to be both light in weight and durable and has dimensions to conveniently fit within a drawer as would commonly be found in a retail store. In practice, a drawer insert 50 has been formed to be 25 inches in length, with a width of 21 inches, and a height of 8½ inches.

Figure 6:
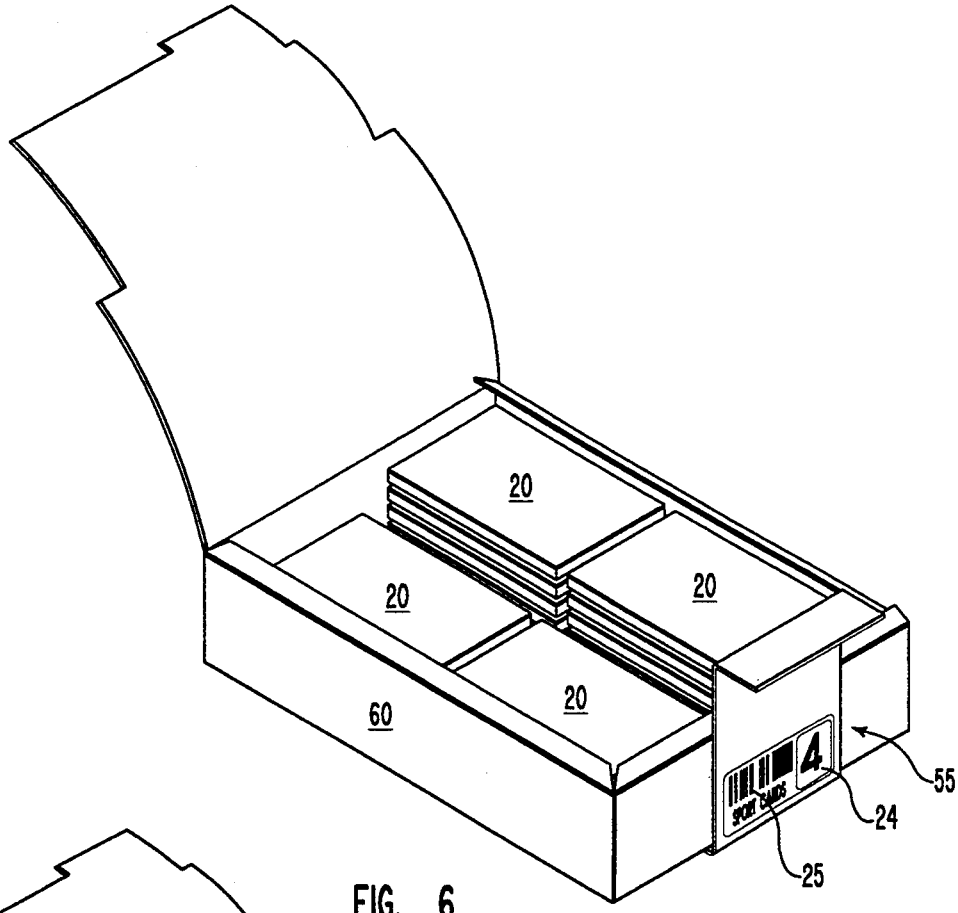
FIG. 6 is side elevation profile perspective view of a box of packs of trading cards, showing the divider of FIG. 4 arranged to identify the box as containing an inventory of particular packs of trading cards.
Figure 7:
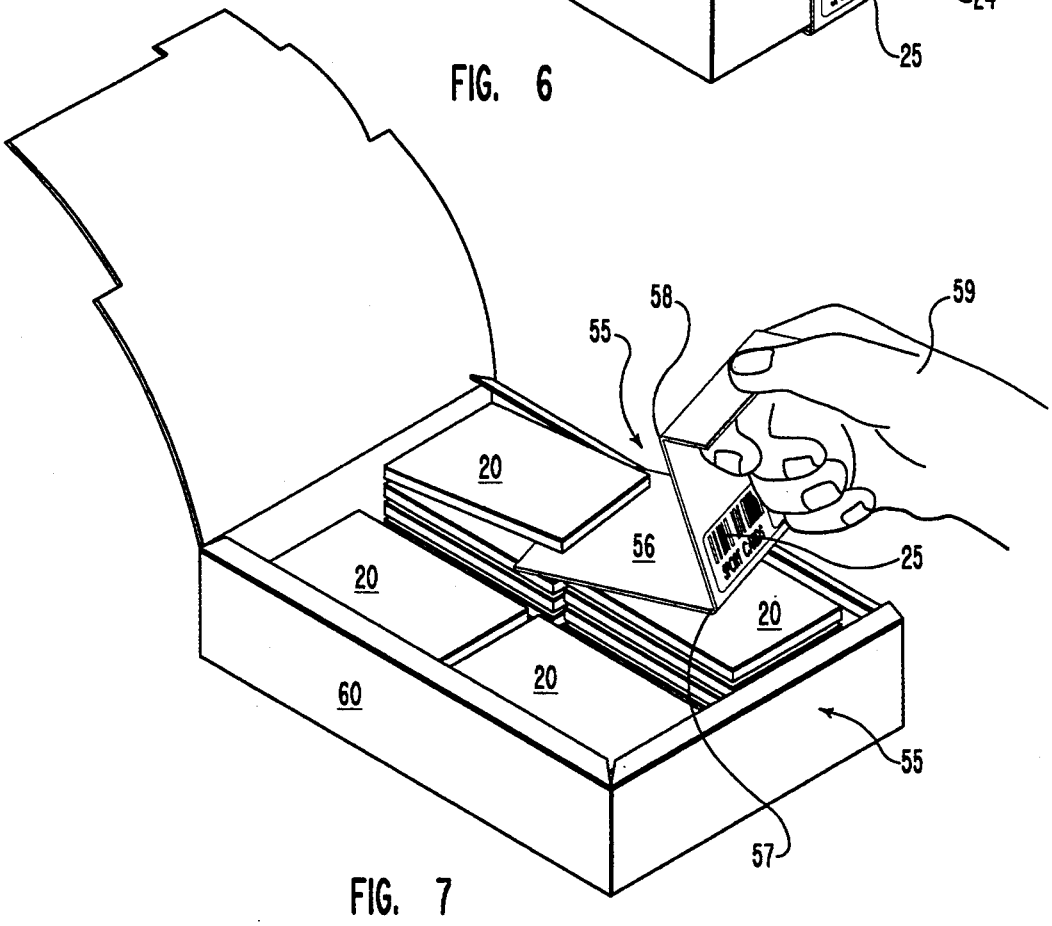
FIG. 7 is a view of the box of FIG. 6 showing the divider held and manipulated by a sales person to lift a top pack of trading cards off of a column packs.

A divider 55, as shown in FIGS. 4 through 7, is preferably provided for both separating and identifying the piles of items 20 arranged in drawer insert 50, as shown in FIG. 4. The dividers can also be utilized for identifying the contents of a box 60 of items 20, as shown in FIG. 6. Divider 55 is shown in profile perspective in FIG. 5 as being formed from a flat narrow rectangular section 56 of a material, such as a plastic, to be light in weight and flexible. To form the divider 55, the section 56 is bent at 57 at a right angle thereacross at approximately a mid point therealong, forming a long section, and is bent at 58 at a right angle opposite to bend 57, proximate to one section end, forming a short section that is for gripping between a person's fingers 59, as shown in FIG. 7.

FIG. 4 shows the divider 55 long section fitted between piles of items 20, separating the items within the individual rows between drawer insert 50 end and divider walls 52 and 53. So arranged, numbers 24 are fixed to the divider area between bends 57 and 58 that is on top of a pile of items 20 when the long section is fitted between piles. Which numbers 24 correspond to the numbers 24 that are assigned to the areas on the cabinet 10 shelves 19, identifying a particular area that an item is maintained on. Accordingly, a person identifies an item 20 by its number 24 that they record on order form 35. A sales person, using that number 24, identifies a pile of items 20 that they select the number of items as the customer has ordered from and sell same to the customer. Additional to number 24 on each divider 55, the bar code 25 is preferably also fixed to the divider, alongside of the number 24, for providing inventory control utilizing a bar code reader that is passed thereover to both record a sales transaction and for indicating the removal of a number of items 20 as are sold from inventory.

FIGS. 6 and 7 show an example of a use of boxes 60 of items 20 that are maintained as an inventory of items, with a divider 55 shown used to identify the items contained in which box. Such inventory arrangement is utilized in lieu of the drawer insert 50 as described above. In the inventory arrangement of FIG. 6, the divider 55 long section is shown fitted under the box 60, exposing the number 24 and bar code 25 thereon. In FIG. 7, the divider 55 is shown being used to lift an item 20 off of a pile of items, showing the fingers 59 of an operator's hand gripping the divider short end and fitting the divider long section under the item so as to lift it to facilitate the divider short end being gripped by the fingers of the operator's other hand. Which divider 55 utilization, as shown in FIG. 7, is applicable also for lifting a top item or items 20 off from one of the piles of items shown arranged in the drawer insert 50.

FIG. 8 is like FIG. 1 except that it illustrates another embodiment of a cabinet 10 key lock 65. Shown therein, key lock 65, like the pair of key locks 26, is for locking the door 22 in covering engagement over the item 20 storage area of cabinet 10. Unlike the pair of key locks 26, FIG. 8 shows a single key lock 65 that consists of a barrel 66 that is journaled through a hole formed through the door 22 and mounts a handle 67 on one end. The barrel 66 extends outwardly from the front surface of door 22, with straight rods 68*a* and 68*b* coupled at pivots 69*a* and 69*b* to the barrel opposite end. A key hole, not shown, is provided in the barrel 66 handle end to receive a key, not shown. Turning of the key allows the handle 67 to be rotated so as to unlock the key lock 65, as described below. When the handle 67 and connected barrel 66 are turned approximately ninety (90) degrees from the attitude shown in FIG. 8, the ends of rods 68*a* and 68*b* that are connected to pivots 69*a* and 69*b* will be drawn across the barrel 66. The travel of rods 68*a* and 68*b* are guided by guide sleeves 70*a* and 70*b* that are secured to the inner surface of door 22. So arranged, with handle 67 turning, ends 71*a* and 71*b* of the rods 68*a* and 68*b* are urged into or drawn out of holes 72*a* and 72*b*, shown in broken lines, that are formed in the top and mid section walls 16*c* of the forward mounting wall, locking and unlocking door 22 over the cabinet front.

As set out above, the system of the invention includes the display cabinet 10, an item storage arrangement that may include the drawer insert 50, boxes 60, or the like, with the divider 55 for arrangement therewith, and includes an arrangement, shown as the order form 35, whereby a purchaser without having physical access to the items displayed in the cabinet 10, can select an item or items, shown as packages of trading cards 20. This selection is indicated on the order form, and that order is filled and the purchase price collected by store personnel at a store location whereat an inventory of the items 20 is maintained.

Utilizing the system of the invention, a practice of the method of the invention includes a customer selecting an item, such as a pack or packs of trading cards, by observing same through a cabinet 10 transparent door 22. The door 22 is locked in covering arrangement over a cabinet 10 face wherein a number of the items are displayed on horizontal shelves maintained therein. The customer orders his selection by then filling out the order form that they take to a store location whereat an inventory of the items is maintained. A sales person at that store location determines from the order form the items and numbers thereof that the customer wishes to purchase. The sales clerk, by reference to the numbering on dividers 55 that are used to identify and separate piles of items, selects the particular item or items and numbers thereof that a customer desires to purchase. The sales clerk then removes the ordered items from the selected piles of items. The sales clerk utilizes the bar coding on the divider or dividers to designate the item or items being sold by running a bar code reader thereover to determine cost to the purchaser and for inventory control. The items are then paid for by the customer.

Hereinabove has been set out a preferred embodiment of the display apparatus and method of the invention. It should, however, be understood that the present disclosure is made by way of example only and that variations and changes to the preferred embodiment of the invention as shown and described are possible without departing from the subject matter coming within the scope of the following claims, and a reasonable equivalency thereof, which claims I regard as my invention.

I claim:

1. A display system comprising, a narrow rectangular display cabinet with means for mounting it to a flat surface, and includes, a forward mounting wall wherein a number of horizontal shelves are secured thereacross at spaced intervals that are of like depth to accommodate a thickness of an item, such as a pack of trading cards, different items individually seated at spaced intervals along each said shelf, and including transparent rails secured at right angles to forward faces of said shelves to support foot ends of said items therebehind, said transparent rails each including sequential identifiers, where behind each said identifier an item is supported on said shelf, and including a door that is formed from a transparent material and is fitted across said cabinet front, with means for locking said transparent door across said cabinet front; a means for enabling a customer to select an item or items for purchase with reference to said items contained in said cabinet by recording the item or items identifier for transmission to a store employee at a store location whereat an inventory of items is maintained; means for separately maintaining an inventory of individual items; and a divider means for each number of the same individual items and includes an identifier fixed thereto that corresponds to the identifier used for a particular item arranged on said display cabinet transparent rails.

2. A display system as recited in claim 1, wherein the display cabinet includes back and forward mounting walls for joining together to include the horizontal shelves and includes end and side wall sections that have faces that are parallel to said forward mounting wall and are approximately in the same plane as forward faces of the transparent rails, and the transparent door is a single section formed to extend between said end and side wall faces, and is hinge connected along one transparent door edge to a side wall section.

3. A display system as recited in claim 2, wherein the transparent door includes an edge that is turned to form a right angle lip, with a lip formed along one side of said transparent door for receiving one side of a pin hinge with an opposite side of said pin hinge secured to the display cabinet side wall section, the end of said transparent door lip for engaging the end and side wall sections faces when said transparent door is closed thereover.

4. A display system as recited in claim 3, further including lock means mounted in said transparent door that, when operated, extends an end of at least one bar means mounted thereto to travel into a side wall section of the display cabinet, locking said transparent door in covering engagement across said display cabinet.

5. A display system as recited in claim 4, wherein the lock means includes a cylinder that is journaled through the transparent door, adjacent to the door lip, and includes a keyway formed in one end for receiving a key to turn said cylinder, and mounts the bar means on another end of said cylinder that is turned by turning said cylinder to move an end of said bar means into a recess formed in the side wall section.

6. A display system as recited in claim 5, wherein the lock means includes a pair of identical locks, each including a sleeve that is fitted through the transparent door and wherein the cylinder is journaled, said cylinder mounting on its end opposite to the key way, a bar as the bar means for turning therewith to move a bar end into a slot formed in the side wall section that is opposite to the side wall section whereto said transparent door is hinge connected.

7. A display system as recited in claim 5, wherein the lock means is a single lock having a cylinder that is journaled through the transparent door and mounts a handle onto an end of said cylinder that extends from said transparent door forward face, and mounts, to another cylinder end, at opposite sides thereof, ends of a pair of rods as the bar means, the said rods each fitted through a guide that is secured to said transparent door inner face, to extend the length of said transparent door, with ends of said rods each to travel a into hole formed in each of the forward mounting wall end walls, the rod ends to travel into and withdraw from said end wall holes when said handle is turned; and including key lock means with said cylinder for restricting handle turning until a key fitted in said key lock means is turned appropriately.

8. A display system as recited in claim 1, further including bar codes that represent an item identifier by one of said identifiers that are fixed alongside its identifier onto the transparent rails for each item as is displayed.

9. A display system as recited in claim 1, wherein the means for enabling a customer to select an item or items is an order form that a customer writes on to identify an item or items and number thereof that they wish to purchase; and means for maintaining a number of order forms at the display cabinet.

10. A display system as recited in claim 1, wherein the display cabinet includes a lower section that the transparent door does not cover over that is formed to have a number of equal spaced holes therein that are appropriately spaced for receiving coupling ends of peg board hangers mounted thereto, said peg board hangers for receiving and maintaining items hung therefrom that are offered for sale.

11. A display system as recited in claim 1, wherein the means for separately maintaining numbers of items by their identifiers is a drawer insert that has a flat, thin rectangular bottom wherefrom like end and divider panels extend upwardly, said drawer insert to fit within a drawer commonly found in a retail store, and said end and divider panels are equally spaced apart to accommodate like piles of items that are positioned at interval between said divider panels that are separated by positioning the divider means therebetween.

12. A display system as recited in claim 11, wherein the drawer insert is formed as a single unit from a plastic material.

13. A display system as recited in claim 1, wherein the divider means is formed from a section of a thin flat rectangular section of material and has a width to convenient fit across an item, the section of material is bent at approximately a right angle across a mid portion thereof to form a lower section, and is bent oppositely to the mid portion bend, at a right angle thereacross adjacent to an end into a finger engaging section; and each divider includes a bar code fixed thereon adjacent to the item identifier.

14. A method for controlling retail sales of items that are subject to theft comprising, installing a number of single items, such as packs of trading cards, in an upright display cabinet that is maintained in a retail store and includes horizontal shelves that are equally spaced vertically and are of a width to accommodate the thickness of said item positioned thereon and includes a transparent rail secured to said shelf face for maintaining each said item on a shelf, said items maintained at equal spaced intervals along each said shelves, and an identifier is assigned to each item that is fixed to said transparent rail to align with approximately the middle of an item positioned therebehind, said identifiers arranged in ascending or descending order across said transparent rails, with said individual items and their identifiers on display through a transparent door that can be locked across said display cabinet and through said transparent rails; a customer, views said items in said display cabinet through said transparent door and transparent rails, and selects items for purchase and marks that selection on an order form; moving that order form to a separate store location whereat an inventory of items is maintained; and a sales person at said separate store location, with reference to each identifier scribe on the order form, selects and removes from piles of individual items, a number of each item as the customer has ordered, that bear the same identifiers as those displayed in said display cabinet; that the sales person conveys to the customer for payment.

15. A method for controlling retail sales of items that are subject to theft as recited in claim 14, further including identifying the piles of like items in inventory with reference to a divider that is for arrangement with each pile and has an identifier fixed thereon for each pile of like items.

16. A method for controlling retail sales of items that are subject to theft as recited in claim 15, wherein the divider includes a section thereof for contact with each pile of like items as said divider is identified with.

17. A method for controlling retail sales of items that are subject to theft as recited in claim 15, further including fixing a bar code for a particular item on the transparent rail adjacent to an item identifier and onto the divider adjacent to said item identifier; and reading that bar code with a bar code reader at the time of sale to produce a sales receipt and for indicating a removal from inventory of each sold item.

18. A method for controlling retail sales of items that are subject to theft as recited in claim 14, wherein the identifiers are sequential numbers, starting with one (1), that is fixed to the top transparent rail left side and continuing to the bottom transparent rail right side, said numbers spaced apart a distance to allow each item to be approximately centered therebehind.

* * * * *